United States Patent [19]

Zrinyi

[11] 4,089,443

[45] May 16, 1978

[54] AEROSOL, SPRAY-DISPENSING APPARATUS

[76] Inventor: Nicolaus H. Zrinyi, 3438 W. 75th St., Los Angeles, Calif. 90043

[21] Appl. No.: 748,240

[22] Filed: Dec. 6, 1976

[51] Int. Cl.[2] ..... B65D 83/14

[52] U.S. Cl. ..... 222/386.5; 222/397

[58] Field of Search ..... 222/386.5, 397, 389, 222/80, 82, 5, 94, 95

[56] References Cited

U.S. PATENT DOCUMENTS

| | | | |
|---|---|---|---|
| 3,070,265 | 12/1962 | Everett | 222/386.5 |
| 3,140,802 | 7/1964 | Everett | 222/386.5 |
| 3,178,075 | 4/1965 | Riedl et al. | 222/386.5 |
| 3,241,722 | 3/1966 | Nissen | 222/386.5 X |
| 3,407,974 | 10/1968 | Chmielowiec | 222/386.5 |
| 3,620,420 | 11/1971 | Normos | 222/386.5 |
| 3,828,977 | 8/1974 | Borchert | 222/386.5 X |

*Primary Examiner*—Robert B. Reeves
*Assistant Examiner*—John P. Shannon
*Attorney, Agent, or Firm*—Francis X. LoJacono

[57] ABSTRACT

An aerosol, spray-dispensing apparatus comprising an outer, sealed container various neutral propellants are stored therein, an inner container having the lower portion thereof compressibly affected by the neutral propellant when the spray head of the spray valve is activated, the head and valve being attached to the outer, pressurized container in a normal manner, wherein the inner container includes an upper, non-collapsible, body member positioned within the pressurized container so as not to be affected by the internal pressure of the propellant gas stored therein. As arranged, the inner container provides a non-contaminated compartment wherein the active ingredient to be discharged is stored and sealed from the gas filled compartment of the outer container, whereby the pressure of the propellant gas therein will only collapse the lower, thin bag portion of the inner container, providing total discharge of the stored ingredient—be it in liquid or powder form.

1 Claim, 9 Drawing Figures

FIG. 8.
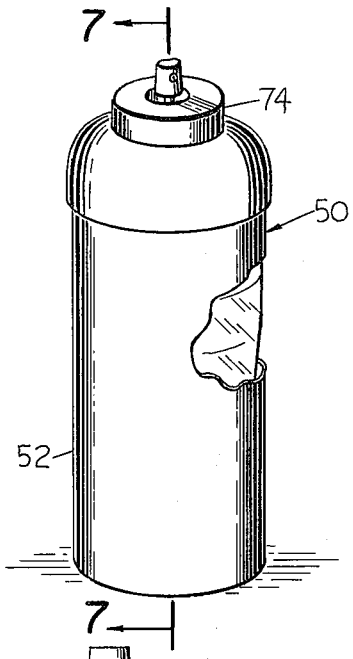
FIG. 9.
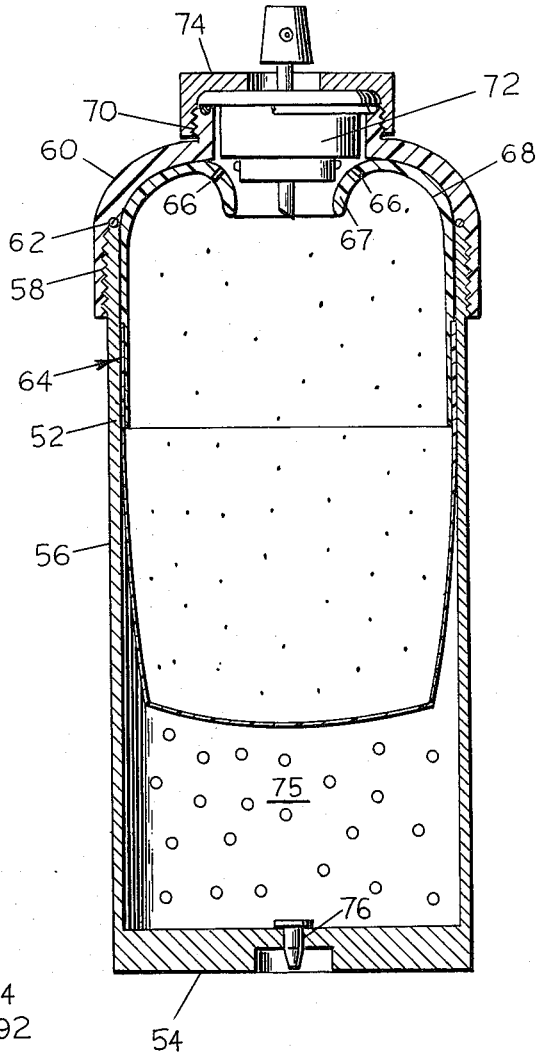
FIG. 6.
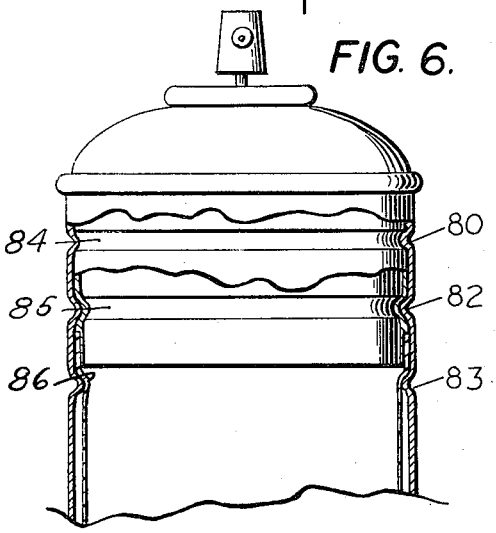
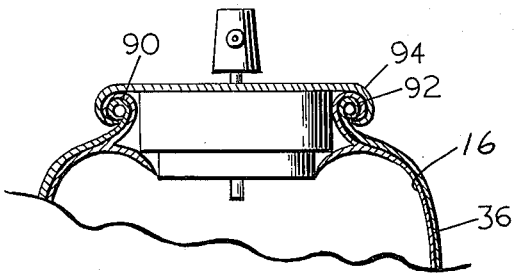
FIG. 7.

AEROSOL, SPRAY-DISPENSING APPARATUS

BACKGROUND OF THE INVENTION

1. Field of the Invention

This invention relates generally to a self-contained spray device using a pressurized gas as a propellant and, more particularly, to an aerosol, spray-dispensing apparatus having a second inner container sealed from the propellant and separately activated thereby.

2. Description of the Prior Art

As is well known in the art, various problems and difficulties are being encountered in the use of aerosol-spray units, particularly with respect to the propellant gases being employed.

It has recently been found that aerosol, spray propellants are, in fact, gradually depleting the earth's protective shield of ozone; and this may lead to an increased risk of skin cancer and other reactive problems. The most widely used and effective gas sprays are fluorocarbon propellants.

Atmospheric chemists contend that chlorine atoms that break free from fluorocarbon propellants under the influence of sunlight are depleting the earth's high-altitude, ozone shield by about 0.1% each year. Thus, other propellants or compressible means must be found.

SUMMARY OF THE INVENTION

The present invention comprises an aerosol, spray-dispensing apparatus that comprises an outer, sealed container of the well-known type that is adapted with a spray valve having a spray-discharge head through which the ingredient to be sprayed passes. Disposed within the first sealed container is a second sealed container formed of two sections—an upper, semi-rigid body preferably of a plastic material, a second section having a collapsible plastic bag secured thereto, thereby forming a separate sealed container wherein the lower half, i.e., the bag, is affected by the pressurized gas propellant stored within the compartment of the outer container. The inner container will hold whatever ingredient is to be discharged. This could be any of the well-known materials now being used, but without the co-mingling of gas with the active ingredients, such as paints, deodorants, insecticides—and particularly food products and the like.

Thus, with the arrangement as presently disclosed, the propellant does not mix with the body of the material being sprayed and is completely separate therefrom.

Accordingly, the outer container is filled with a propellant—generally from the bottom, in which a sealed plug is disposed. As the valve is operated—the pressure in the compartment of the outer can being greater—the atmospheric pressure will cause the bag portion of the inner container to collapse, thereby forcing the stored ingredient therein to be discharged through the spray head.

It is important to note that the bag section is forced upwardly and inwardly wherein the upper body of the inner container is not affected by the pressure, other than to be forced even tighter against the inner wall of the outer container. Thus, the collapsible bag can be forceably moved to discharge almost all the material stored therein.

To allow the gas propellant therein to escape, the bag is caused to be punctured by the depending valve stem, thereby allowing the gas therein to be discharged for safety reasons. It is contemplated that, with the above arrangement of the inner container, air under suitable pressures—$Co_2$ gas or any non-fluorocarbon propellants—can be used.

A second embodiment is also contemplated wherein the outer container is so arranged that it can be used again with the insertion of additional inner containers that would have different materials stored therein for interchangeability. For example, one container might have paint and another might have an insecticide.

Accordingly, this embodiment comprises a removable, upper body member which is threadably secured to the lower, outer container body, the container body having a closed bottom wall adapted with a filling valve to allow various gases to be injected into the chamber of the outer container. The inner, sealed container is identical to that previously described and is arranged in the outer container in the same manner. However, the spray valve and the spray head are removably supported in the upper body of the outer container by means of a removable cap.

It should be noted that other variations are herein shown and described.

OBJECTS AND ADVANTAGES OF THE INVENTION

The present invention has for an important object a provision wherein the dispensing ingredient is not co-mingled with the propellant gas; and wherein the propellant gas used therein can be air, $Co_2$ or any suitable gas that does not include fluorocarbons.

It is another important object of the invention to provide an aerosol device of this type that includes a second inner container, wherein only the lower half of the inner container is collapsible; and the upper half is tightly formed along the inner wall of the outer container, whereby the pressure therein does not affect that portion of the inner container.

It is still another object of the invention to provide an aerosol-dispensing apparatus that allows all the ingredients therein to be discharged before the gas is allowed to escape therefrom.

It is a further object of the invention to provide an apparatus of this type wherein the propellant is prevented from escaping with the material being sprayed, thereby conserving the propellant.

It is still a further object of the invention to provide an apparatus of this character that is relatively inexpensive to manufacture; and wherein the reusable type is easy to service and maintain.

Still another object of the present invention is to provide an aerosol spray can that prevents waste of the active ingredient by loss of all the propellant prior to complete discharge of the active ingredient.

A still further object of the invention is to provide the use of higher propellant pressures, without substantial reduction in the active ingredient disposed in the inner container.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

FIG. 6 is a similar view to that of FIG. 5, showing an alternative arrangement for supporting the inner container in place;

FIG. 7 is a cross-sectional view showing the upper portion of the inner container being connected between the outer container and the spray means;

FIG. 8 is a perspective view of the alternative embodiment of the invention whereby the outer container is designed for reuse; and FIG. 9 is an enlarged, sectional view taken substantially along line 9—9 of FIG. 8.

DESCRIPTION OF THE PREFERRED EMBODIMENT

Figure 1:
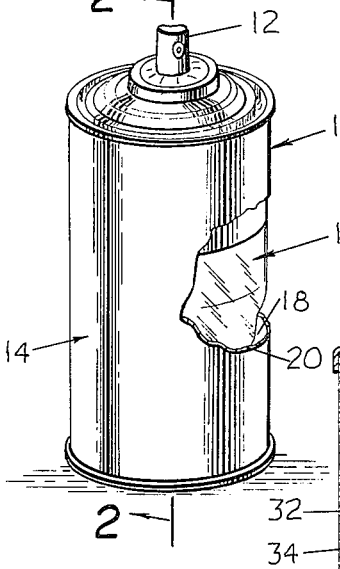
FIG. 1 is a perspective view of a spray can having a portion thereof broken away, showing the inner, flexible container which holds the active ingredient therein.

Referring to FIGS. 1 through 5 and more particularly to FIG. 1, there is shown an aerosol, spray-dispensing apparatus, generally indicated at 10, having an exposed spray head 12 operably mounted to the top of a can 14 which will hereinafter be referred to as the outer container. A portion of outer container 14 is broken away so as to show the inner container, designated generally at 16, being disposed within the pressure chamber or compartment 18.

It should be noted that, in this embodiment, the outer container can be of any suitable, well-known construction that is presently being used, wherein the outer container 14 comprises an annular wall 20 having a dual-sealed, cap wall member 22. A suitable discharge valve means 24 is secured to cap wall 22 having spray head 12 mounted thereon in the well known manner. The lower end of container 14 is provided with a bottom, sealed wall 26 which is adapted with a central hole 28 in which a sealing plug is secured.

Accordingly, there is defined by outer container 14 pressure chamber 18, in which a gas propellant 30 is stored. It should be noted that said gas propellant can be of any suitable type that does not include fluorocarbons. That is, it is contemplated that air can be used under high pressure, or $Co_2$ gas can be charged therein. As will be further understood, none of the propellants are allowed to mix with the active ingredients to be discharged.

Figure 2:
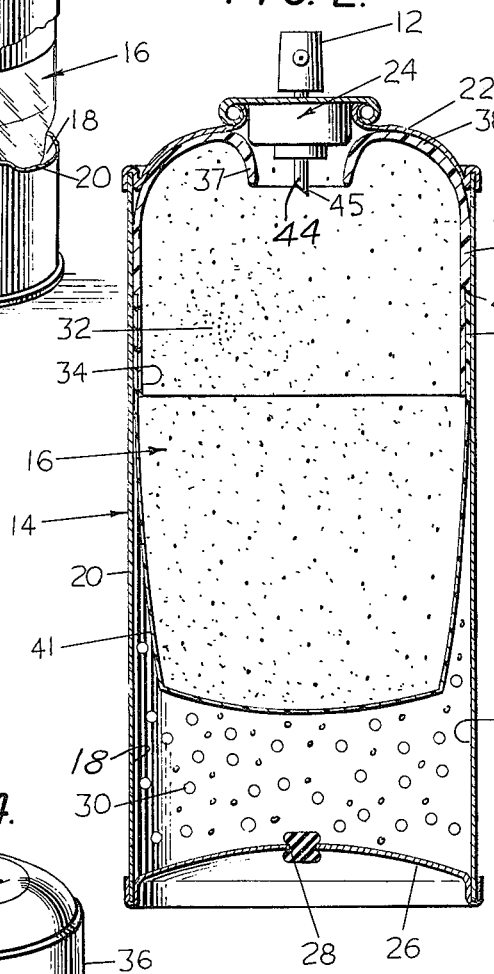
FIG. 2 is an enlarged, cross-sectional view taken along line 2—2 of FIG. 1.

Referring to FIG. 2, there is shown a cross-sectional view of the outer and inner containers 14 and 16, respectively, wherein the inner container 16 is filled with a suitable active ingredient 32 which is sealed in chamber 34. Chamber 34 is defined by inner container 16 which comprises an upper, semi-rigid, plastic body 36 that conforms to the configuration of the upper portion of chamber 18 of the outer container 14. Body 36 is formed having a somewhat convexed dome 38 in which a central, depending, annular collar 37 is integrally shaped. Extending downwardly from the dome portion 38 is an annular wall 40 which fits snugly against the inner surface of wall 20 of the outer container 14. The distal, free end of body 36 has therein provided a peripheral recess 39 to which a flexible plastic bag 41 is sealed and secured thereto.

Figure 3:
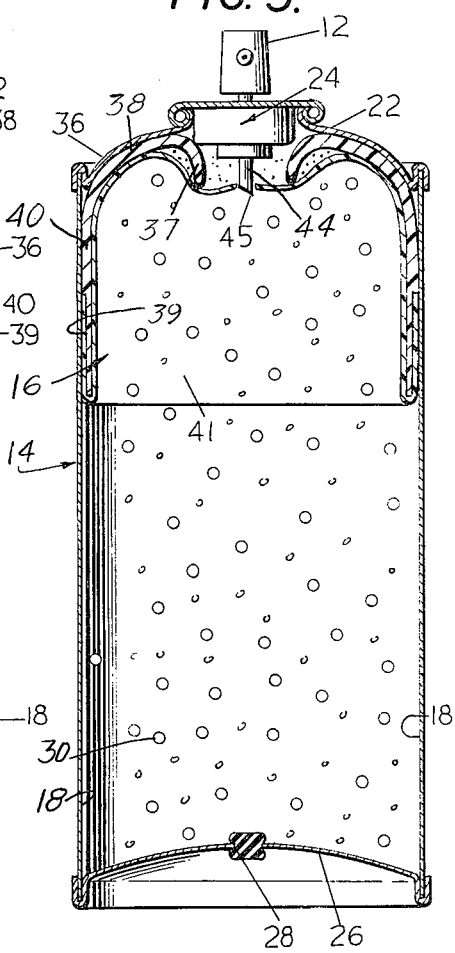
FIG. 3 is a similar view to FIG. 2, showing the lower bag portion of the inner container fully collapsed.
Figure 4:
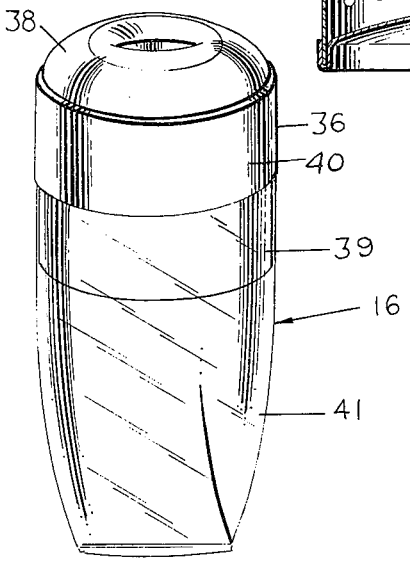
FIG. 4 is a perspective view of the inner container in which the active ingredient is disposed therein.

When the inner container 16 is positioned within chamber 18 of the outer container, cap wall 22 is secured thereon and valve means 24 is received in opening 42 formed by collar 37 (See FIGS. 2 and 3). These allow discharge stem 44 of valve 24 to be positioned at the opening of chamber 34 of the inner container.

Thus, when chamber 18 is loaded with the required pressure of gas propellant, the only portion of the inner container being affected by the pressure is the flexible bag 41. The annular wall 40 of body 36 tightly engages the inner surface of wall 20; and thus the gas propellant has no effect on the upper body.

Accordingly, bag 41 will be forced upwardly and outwardly, as seen in FIG. 3, whereby almost all of the active ingredient is allowed to be discharged through valve 24.

It should be noted that, in some cases, it would be necessary to release the entrapped gases; so, with this in mind, discharge stem 44 can be provided with a pointed edge 45, which will penetrate through the bag wall and permit the gas propellant to escape, when valve 24 is opened.

Figure 5:
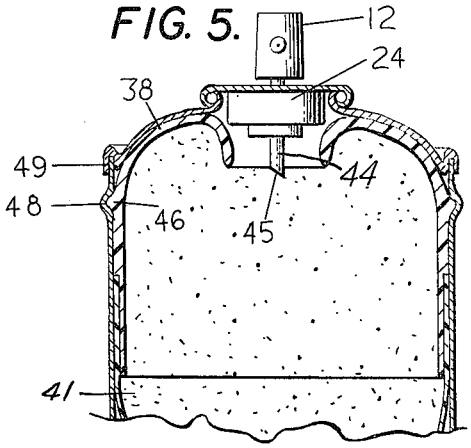
FIG. 5 is a cross-sectional view of the upper portion of the spray-can apparatus wherein there is shown an arrangement to hold the inner container in its proper place with respect to the outer container.

FIG. 5 is a similar embodiment, as seen in FIGS. 1-4; however, body 36 is provided with an annular ridge 46 that is received in a corresponding annular groove 48 of the outer container, just below the sealing crimp 49. Thus, the inner container is sealed in place prior to the top of the can being secured. It is also contemplated that an adhesive will be applied between the inner surface of the can and the outer surface of the plastic body 36, whereby the inner container is held from movement within the outer container.

Other additional securing means are illustrated in FIGS. 6 and 7. In FIG. 6, the outer container is shown having a plurality of spaced, annular ribs 80, 82, and 83, wherein matching annular channels 84, 85 and 86 are formed in the plastic body 36 of the inner container. Thus, the inner container is force-fitted therein so as to be held in place by respective ribs and channels.

Referring to FIG. 7, there is shown a securing means which comprises the addition of an annular, upwardly-extending, flange member 90. Said flange member is formed as an integral part of body 36, wherein said flange 90 is secured to rim 92 of container 14 by superposing the spray cap member 94 over the flange 90 and rim 92. Thus, it can be seen that the inner container 16 is held in a fixed position, allowing only the flexible bottom half of said inner container 16 to move upwardly and inwardly as the valve is operated.

ALTERNATIVE EMBODIMENT

Referring now to FIGS. 8 and 9, there is shown an aerosol spray apparatus, generally indicated at 50, comprising an outer container 52 having a closed bottom wall 54 and an integral, tubular wall 56—the upper, open end of said outer container being provided with external threads 58 to which top member 60 is removably attached. A sealing means is positioned therebetween and is shown as an "O"ring 62. The top 60 is removed when new-insert, inner containers are required. The inner container, indicated generally at 64, is formed in the same manner as previously described in the first embodiment. However, it is contemplated that the holes 66 can be added around collar 67 of the upper dome 68.

Top 60 includes a neck member 70 which is adapted to receive valve means 72, the valve being held in place by a removable cap 74 which threadably secures to neck member 70.

Once the spray apparatus is complete with the inner container and its ingredient, the pressure chamber 75 is filled with air or any suitable gas propellant. This is accomplished by allowing the gas to be received through valve means 76 secured in the bottom wall 54. Thus, air can be pumped in by any suitable means, or $Co_2$ gas can be injected therein by a cartridge. Various arrangements can be adapted to fit valve 76.

It should be noted that, under this arrangement, various configurations of the containers are contemplated.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely be way of example, and I do not wish to be restricted to the specific form shown or uses mentioned, except as defined in the accompanying claims.

I claim:

1. An aerosol, spray-dispensing apparatus of the type having a neutral, pressurized, gas propellant disposed therein to impart a force to discharge stored ingredients therein, said apparatus comprising:

an outer container having a sealed pressured chamber defined thereby; a discharge valve means secured to the upper ends of said outer container to discharge said stored ingredients therein;

means provided in said outer container to charge said gas propellant into said pressure chamber;

an inner container arranged to be disposed in said pressure chamber;

said inner container comprising an upper, semi-rigid body forming an inverted cup member having a central opening therein to receive said discharge valve means therein, said upper body of said inner container conforming to the inner surface of the outer container, whereby opposing surfaces thereof engage each other to prevent said propellant from being disposed therebetween;

a lower, flexible bag member attached to said upper body, wherein said upper body and said lower bag member define a chamber to store said ingredients therein for discharge through said valve means, said ingredients being isolated from said gas propellant;

said upper body member of said inner container comprising:

a dome member wherein said central opening is located, an annular, depending wall arranged to fit in a sealing manner, against said inner surface of said outer container, whereby pressurized gas is prevented from passing therebetween, an annular recess formed in the lower, depending end of said annular wall to receive said flexible bag for securement thereof to said upper body member, said bag being exposed to said pressurized gas whereby said bag is allowed to collapse when said valve is operated for discharge of said ingredients, said bag being arranged to be received in said inverted cup member for total displacement of said ingredients stored therein;

means to provide charging of said gas propellant into said pressure chamber, said means comprising a valve plug disposed in the bottom of said outer container;

means for affixing said inner container to said outer container;

puncture means affixed to said discharge valve means, whereby said flexible bag portion is punctured thereby after total discharge of said ingredients therein, to allow said pressurized gas to be released from said pressure chamber of said outer container.

* * * * *